US008435078B2

(12) United States Patent
Hsueh

(10) Patent No.: US 8,435,078 B2
(45) Date of Patent: May 7, 2013

(54) ELECTRICAL CONNECTOR STRUCTURE WITH MULTI-POLES

(75) Inventor: Chih-Yu Hsueh, Taipei (TW)

(73) Assignee: ANT Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 13/228,048

(22) Filed: Sep. 8, 2011

(65) Prior Publication Data

US 2012/0058687 A1 Mar. 8, 2012

(30) Foreign Application Priority Data

Sep. 8, 2010 (TW) ..... 99217344 U

(51) Int. Cl.
*H01R 24/00* (2006.01)

(52) U.S. Cl.
USPC ..... 439/660

(58) Field of Classification Search ..... 439/660, 439/490, 910, 488, 63, 733.1, 79, 550, 551
See application file for complete search history.

(56) References Cited

U.S. PATENT DOCUMENTS 4,842,184 A * 6/1989 Miller, Jr. ..... 228/180.1
5,065,227 A * 11/1991 Frankeny et al. ..... 257/778
5,323,947 A * 6/1994 Juskey et al. ..... 228/56.3
5,548,488 A * 8/1996 Hansen ..... 361/815
5,553,769 A * 9/1996 Ellerson et al. ..... 228/123.1
6,296,173 B2 * 10/2001 Davis et al. ..... 228/180.22
6,517,895 B1 * 2/2003 Wolfer et al. ..... 427/96.9
7,186,141 B2 * 3/2007 Li et al. ..... 439/573
7,318,749 B2 * 1/2008 Li et al. ..... 439/580
7,566,242 B2 * 7/2009 Zhu et al. ..... 439/567
7,597,583 B2 * 10/2009 Zhuang ..... 439/490

* cited by examiner

*Primary Examiner* — Alexander Gilman

(74) *Attorney, Agent, or Firm* — Muncy, Geissler, Olds & Lowe, PLLC

(57) ABSTRACT

An electrical connector structure with multi-poles includes an isolation body, a pole set, and a circuit connection unit. The isolation body includes a core portion and a recessed ring portion formed around the core portion. The poles include a center pole disposed in the core portion, a first pole disposed on the inner side of the recessed ring portion, and a second pole disposed on the outer side of the recessed ring portion. The center pole, the first pole, and the second pole each includes a main portion and a conduction portion extending from the main portion toward the rear wall of the isolation body. The circuit connection unit is disposed on the rear wall of the isolation body and includes a preformed circuit layout and a plurality of first through holes disposed corresponding to the conduction portions for electrically connecting the circuit layout with the conduction portion.

16 Claims, 17 Drawing Sheets

ELECTRICAL CONNECTOR STRUCTURE WITH MULTI-POLES

BACKGROUND OF THE INVENTION

1. Field of the Invention

This invention relates to an electrical connector structure with multi-poles; specifically to an electrical connector structure that can be incorporated in a wire bonding process.

2. Description of the Prior Art

Progress in electronic products such as portable devices, personal digital assistants, laptop computers and digital cameras increases the need for various types of electrical connectors. Generally, the electrical connectors for transmitting power source and voltages are classified into signal electrical connectors and power electrical connectors. One of the characteristics of the signal electrical connectors is that the current transmitted by the signal electrical connectors is less than 1 ampere and that the signal electrical connectors are required to operate at low or medium voltage. On the other hand, the power electrical connectors are used to transmit high current which is normally greater than 1 ampere. In addition, the power electrical connectors are normally operated at high voltages and therefore cables are normally used for current transmission in order to prevent the occurrence of excessively high resistance or temperature which may influence the transmission of current.

As for laptop computers, the trends toward smaller laptop computers require the electrical connectors to be more compact than ever before and this trend creates more requirements on the production process of every element of the power electrical connectors. In order to connect the conventional power electrical connectors with cables, several ribs are formed at the bottom of an isolation rubber of the electrical connector body to prevent the occurrence of short-circuit between cables or terminals. However, it is difficult to solder cables on the power electrical connector because the limited rear wall of the power electrical connector is often required to be soldered with tens of cables. This can even create defects such as short-circuit within the power electrical connector.

How to effectively manage the cables soldered on the surface of the compact power electrical connectors and prevent the occurrence of excessively high resistance or temperature needs to be worked on. In view of this, it is the inventor's wish to solve the problem mentioned above and the present invention is the result of the inventor's hard work and years of experience in research and development in the field of electrical connectors.

SUMMARY OF THE INVENTION

It is an objective of the present invention to provide an electrical connector structure with multi-poles whose production is integrated in a wire bonding process.

It is another objective of the present invention to provide an electrical connector structure with multi-poles whole wires are easy to arrange.

It is yet another objective of the present invention to provide an electrical connector structure with multi-poles which requires less production time and costs.

The present invention provides an electrical connector structure with multi-poles including an isolation body, a pole set, and a circuit connection unit. The isolation body includes a core portion and a recessed ring portion formed around the periphery of the core portion. The pole set includes a centre pole, a first pole, and a second pole. The centre pole is disposed in the core portion from the rear wall of the isolation body. The first pole is disposed on the inner side of the recessed ring portion and the second pole is disposed on the outer side of the recessed ring portion. The centre pole, the first pole, and the second pole each includes a main portion and a conduction portion extending from the main portion toward the rear wall of the isolation body. The circuit connection unit is disposed on the rear wall of the isolation body and includes a preformed circuit layout and a plurality of first through holes. The first through holes are disposed corresponding to the conduction holes for electrically connecting the circuit layout with the conduction portion.

In a more preferred embodiment, the core portion includes a first groove on the surface of the core portion, wherein the first pole is disposed in the first groove. The isolation body includes a second groove formed on the surface of the isolation body near the recessed ring portion, wherein the second pole is disposed in the second groove. The first pole and the second pole each includes an elastic portion, wherein the elastic portion extends from the main portion and is exposed in the recessed ring portion. The first pole and the second pole respectively include a plurality of first poles and a plurality of second poles. The main portions of each first pole and each second pole are individually or integrally embedded in the rear wall of the isolation body.

Furthermore, the electrical connector structure further includes a plate disposed between the circuit connection unit and the isolation body. The plate includes a plurality of second through holes corresponding to the first through holes. The aperture of each second through hole is smaller than the aperture of each first through hole to prevent solder or tin paste from permeating into the isolation body. The circuit connection unit is covered with a first plastic material and a second plastic material and then thermosetted. In other words, the circuit connection unit is produced through insert molding. However, in different embodiments, the circuit connection unit can be composed of a first plastic body, a second plastic body, and a plurality of conducting films.

The present invention provides an electrical connector structure with multi-poles which further includes a light emitting diode having a set of conducting electrodes disposed in a slot of the isolation body, wherein the slot is formed below the recessed ring portion.

In a more preferred embodiment, the electrical connector structure further includes a guiding stand having a pair of jacks. The guiding stand is disposed on the circuit connection unit or in the slot so that the set of conducting electrodes can pass through the pair of jacks and enter each first through hole. The core portion includes a plurality of first grooves on the surface of the core portion, wherein each first pole is disposed in one first groove. The isolation body includes a plurality of second grooves formed on the surface of the isolation body near the recessed ring portion, wherein each second pole is disposed in one second groove.

DETAILED DESCRIPTION OF THE PREFERRED EMBODIMENT

The present invention provides an electrical connector structure with multi-poles that can be manufactured in a variety of simpler and more cost-effective processes. The above-mentioned electrical connector structure is preferably a direct current power jack connector. However, in different embodiments, the electrical connector structure can be audio/video connectors, coaxial cable connectors, input/output connectors, or other connector structures having interior and exterior terminals. Furthermore, the cable connected to the electrical connector structure is preferably an electronic wire. However, in different embodiments, the cable can also refer to a coaxial cable or other suitable wires.

Figure 1A:
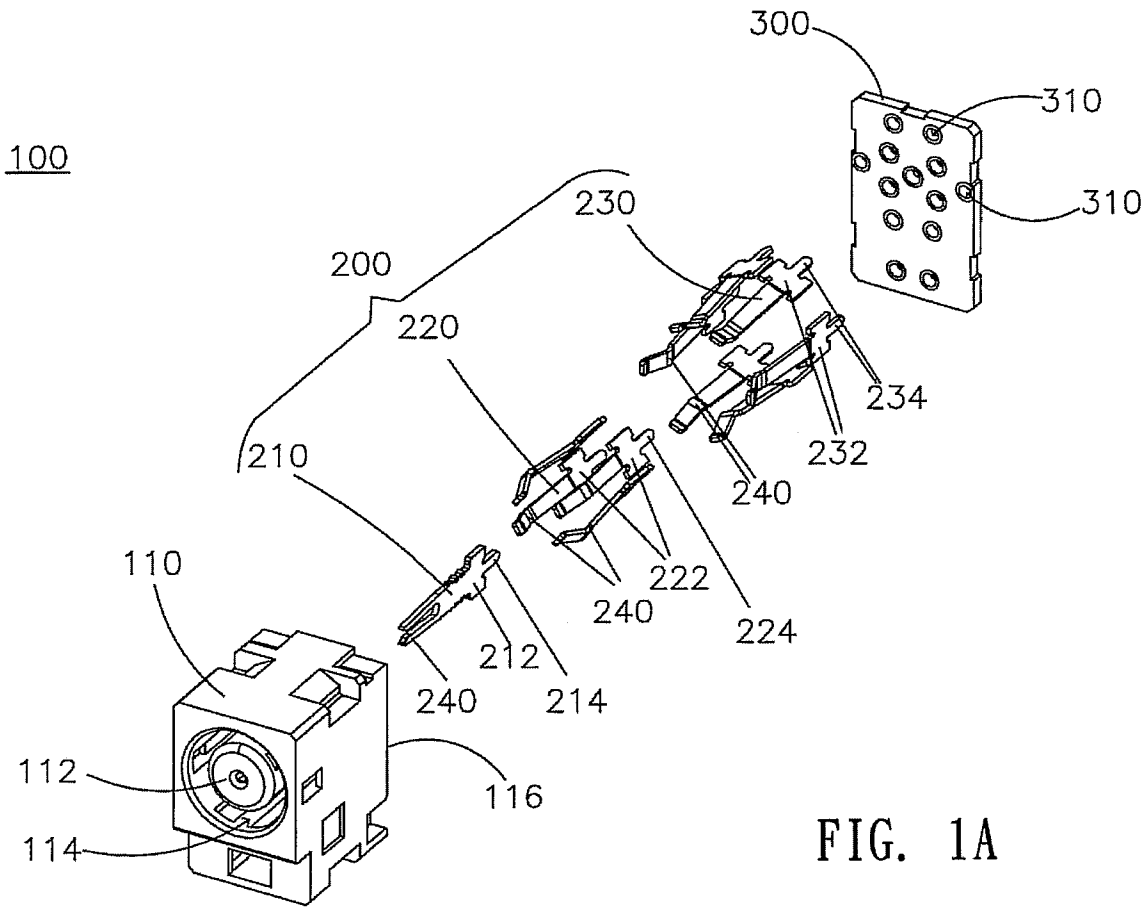
FIG. 1A is an exploded view of the electrical connector structure of the present invention.
Figure 1B:
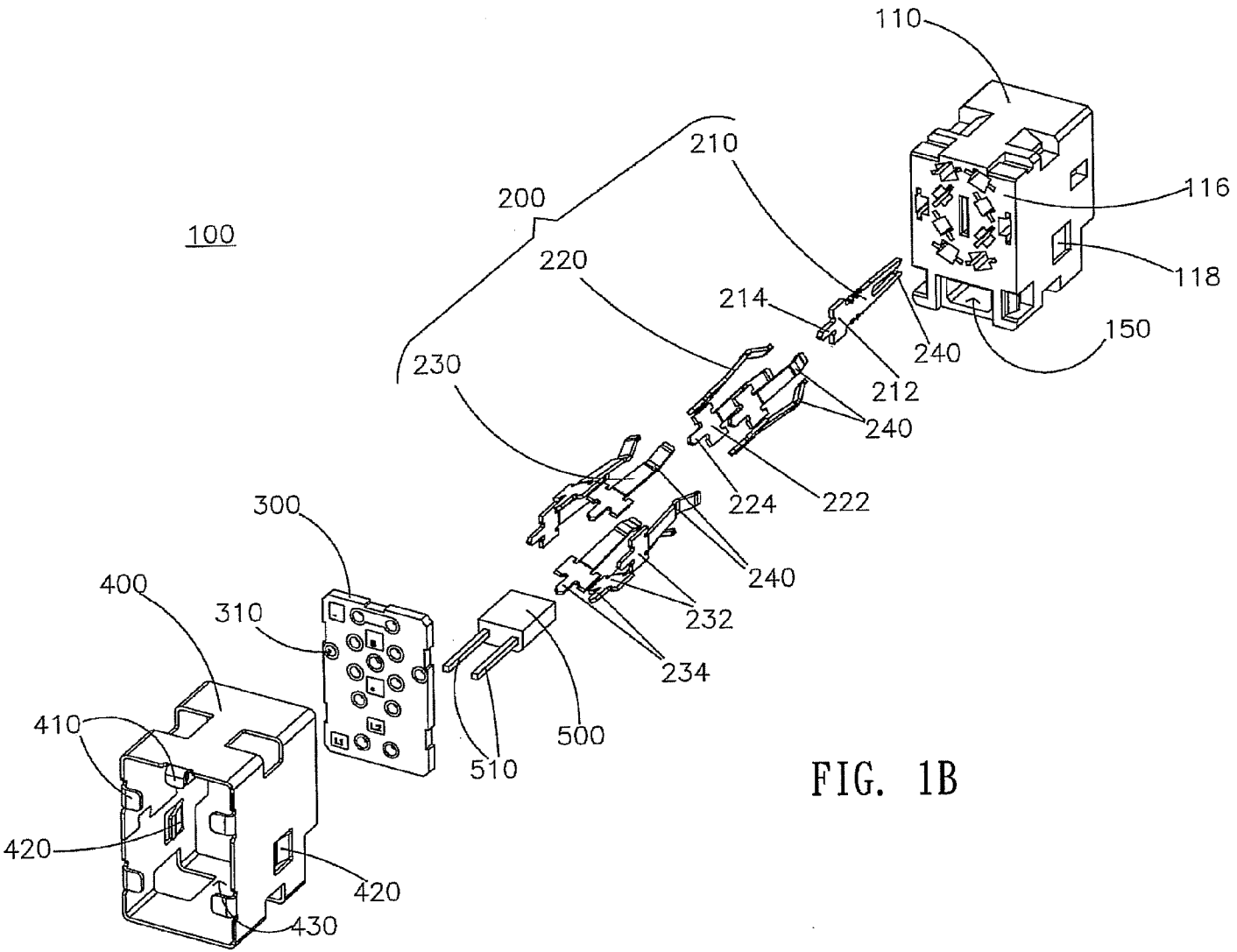
FIG. 1B is an exploded view of another electrical connector structure of the present invention.
Figure 2:
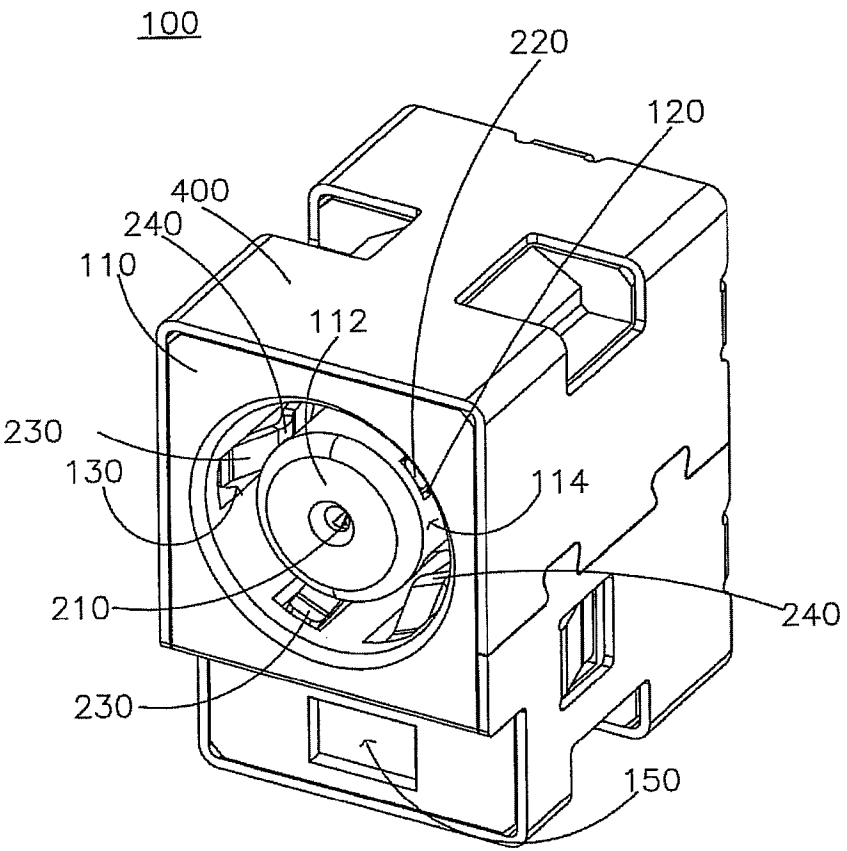
FIG. 2 is a perspective view of the electrical connector structure of the present invention.

As FIG. 1A and FIG. 2 show, the present invention provide an electrical connector structure 100 including an isolation body 110, a pole set 200, and a circuit connection unit 300. However, in the embodiment illustrated in FIG. 1B, the electrical connector structure 100 can further include a light emitting diode 500 with a pair of conducting electrodes 510 and a metal casing 400. The light emitting diode 500 is disposed in the slot 150 of the isolation body 100, i.e. below a recessed ring portion 114. The metal casing 400 is a rectangular casing and has an accommodation space 430 for accommodating the rectangular isolation body 110. The metal casing 400 further includes a bent portion 410 and an engaging portion 420 for positioning the isolation body 110. The structure, number, and location of the bent portion 410 and the engaging portion 420 are as shown in the embodiments but are not limited thereto.

In the embodiment illustrated in FIG. 1A and FIG. 2, the isolation body 110 has a core portion 112 and a recessed ring portion 114 formed around the periphery of the core portion 112. The core portion 112 is in a cylinder shape and preferably extends from the rear wall 116 of the isolation body 110 toward the front. The recessed ring portion 114 is formed as a gap between the core portion 112 and the isolation body 110 to allow a corresponding electrical connector (not illustrated) to plug in. The pole set 200 includes a centre pole 210, a first pole 220, and a second pole 230. The centre pole 210 is disposed in approximately the centre of the core portion 112 and is mainly configured to transmit electrical signals or other signals. The first pole 220 is disposed on the inner side of the recessed ring portion 114 and the second pole 230 is disposed on the outer side of the recessed ring portion 114.

In the present embodiment, the electrical connector structure 100 preferably includes a plurality of separate first poles 220 and a plurality of separate second poles 230 to facilitate the plug-in and plug-out of the corresponding electrical connector (not illustrated). However, in different embodiments, the first pole 220 and the second pole 230 can be integrally formed as a unibody according to design requirements. In the embodiment illustrated in FIG. 2, the longitudinal axis of the core portion 112 serves as an arrangement center of the first poles 220, so that the first poles 220 are disposed in the first grooves 120 formed on the surface of the core portion 112, wherein the first poles 220 can be equidistantly or non-equidistantly arranged with respect to the arrangement center. Similarly, the longitudinal axis of the core portion 112 can also serve as the arrangement center of the second poles 230, so that the second poles 230 can be disposed in the second grooves 130 formed on the surface of the isolation body 110 near the outer rim of the recessed ring portion 114, wherein the second poles 230 can be equidistantly or non-equidistantly arranged with respect to the arrangement center.

As FIGS. 1A, 1B, and 2 show, the centre pole 210, the first pole 220, and the second pole 230 each includes a main portion 212, 222, 232, a conduction portion 214, 224, 234 extending from the main portion 212, 222, 232 toward the rear wall 116 of the isolation body 110, and an elastic portion 240 extending from the main portion 212, 222, 232 toward the front. As mentioned in the previous embodiment that the pole set 200 can be integrally formed into a unibody, this means the main portions 222 of the first poles 220 are connected to each other and the main portions 222 of the second poles 230 are also connected to each other. The elastic portions 240 partially protrude out the first grooves 120 and the second grooves 130 and are exposed in the recessed ring portion 114. The elastic portion 240 is configured to be connected to the corresponding electrical connector and to exert more stable clamping forces on the corresponding electrical connector.

Figure 3:
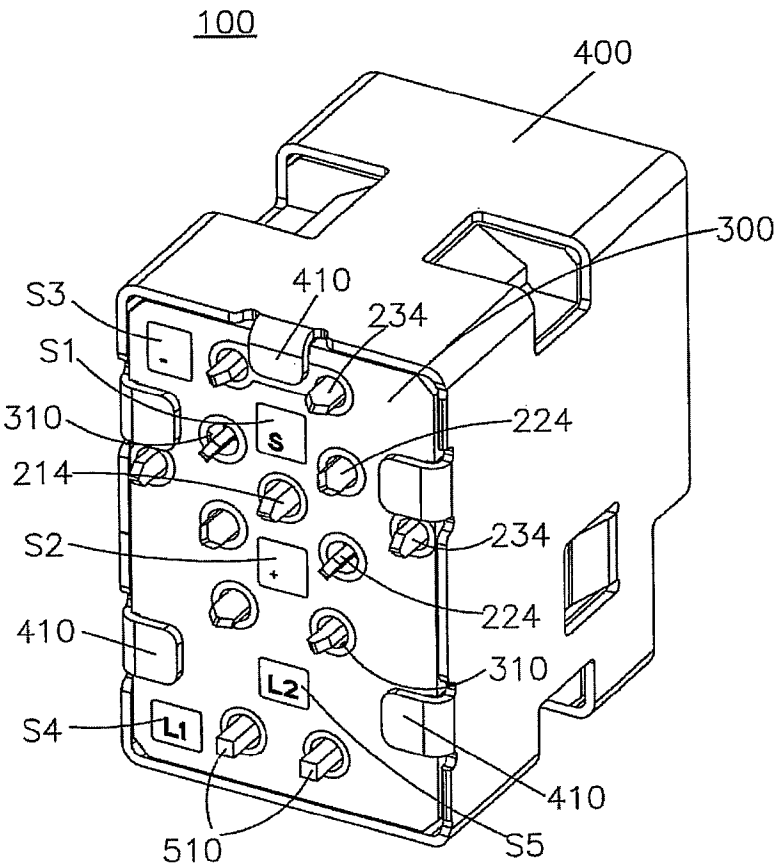
FIG. 3 is another perspective view of the electrical connector structure of the present invention.

Here please refer to FIG. 3, wherein the circuit connection unit 300 is disposed on the rear wall 116 of the isolation body 110 and has a pre-formed circuit layout (not illustrated) and a plurality of first through holes 310. In the embodiment illustrated in FIG. 3, the circuit connection unit 300 is preferably a single layer plate, a double layer plate, or a printed circuit board made of a compound plate. The circuit layout is produced by the photoresist method, the printing method, the electroplate method, the image transfer method, or a combination thereof and is not elaborated here. The first through holes 310 are preferably formed near the circuit layout and disposed corresponding to the conduction portions 214, 224, 234. Afterward different soldering methods can be used to electrically connect the circuit layout with the conduction portions 214, 224, 234.

In the embodiment illustrated in FIG. 3, a plurality of solder pads S1, S2, S3, S4, S5 are formed on the circuit connection unit 300 to be soldered with a cable or wire. By integrating various poles into a single solder pad is beneficial to the management or arrangement of wires. In other words, the circuit connection unit 300 transforms the conduction portions 224 of the first poles 220 into a single solder pad S2 and transforms the conduction portions 234 of the second poles 230 into a single solder pad S3, wherein a single cable can be used to output the signals from the solder pad. Furthermore, the conduction portion 214 of the centre pole 210 corresponds to a solder pad S1 and the conducting electrodes 510 of the light emitting diode are transformed into the solder pad S4, S5, respectively. In this way, for connections, the structure originally requiring 13 cables (one for the center pole 210, four for the first poles 220, six for the second poles 230, and two for the electrodes 510 of the light emitting diode 500) is now reduced to a new structure requiring only 5 cables (one for solder pad S1 of the center pole 210, one for solder pad S2 of the first poles 220, one for solder pad S3 of the second poles 230, and two for solder pads S4, S5 of the electrodes 510 of the light emitting diode 500).

Figure 4:
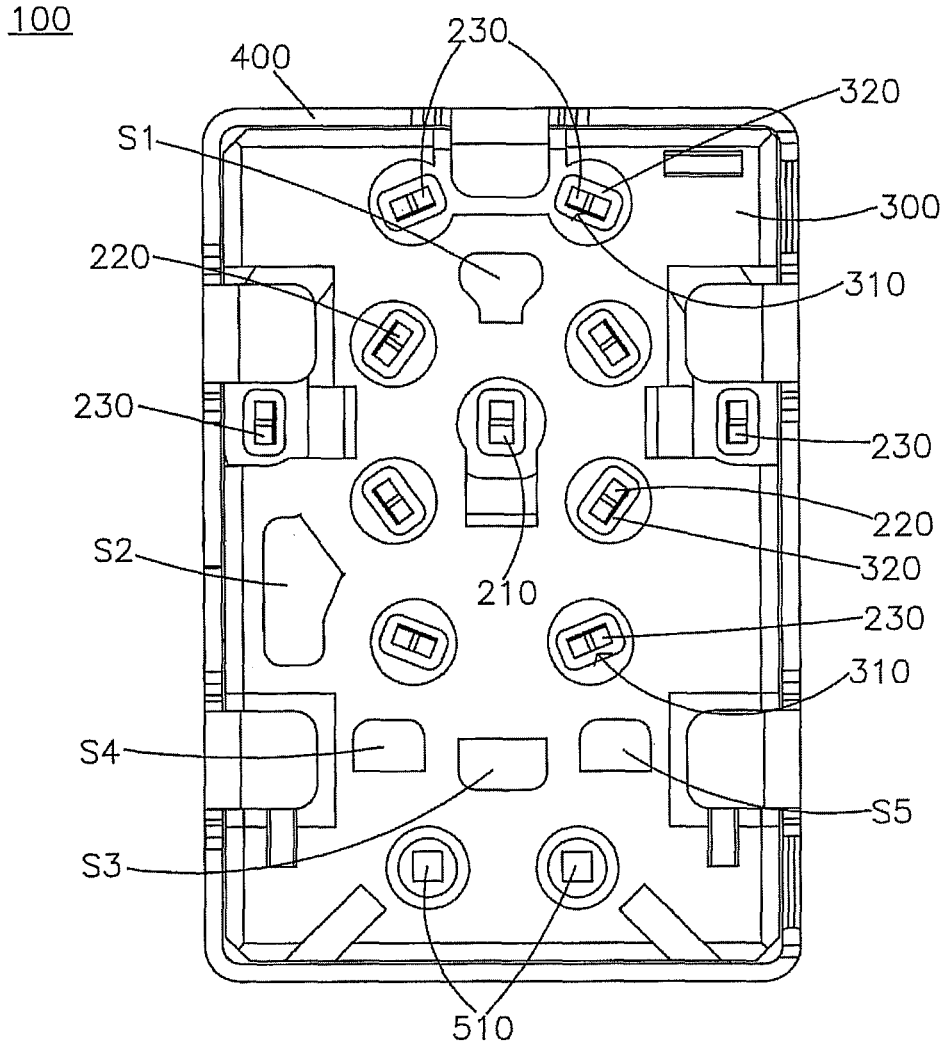
FIG. 4 is a rear view of the electrical connector structure of the present invention, showing several solder pads formed on the electrical connector structure.

As FIG. 4 shows, the solder pads S1, S2, S3, S4, and S5 can be arranged at appropriate locations as shown in the figures but are not limited thereto. In the embodiments illustrated in FIGS. 3 and 4, the soldering process is performed when the conduction portions 214, 224, 234 and the conducting electrodes 510 are disposed corresponding to the first through holes 310 and the circuit layout. In the present embodiment, the solder or silver paste is preferably used for the soldering process.

Figure 5:
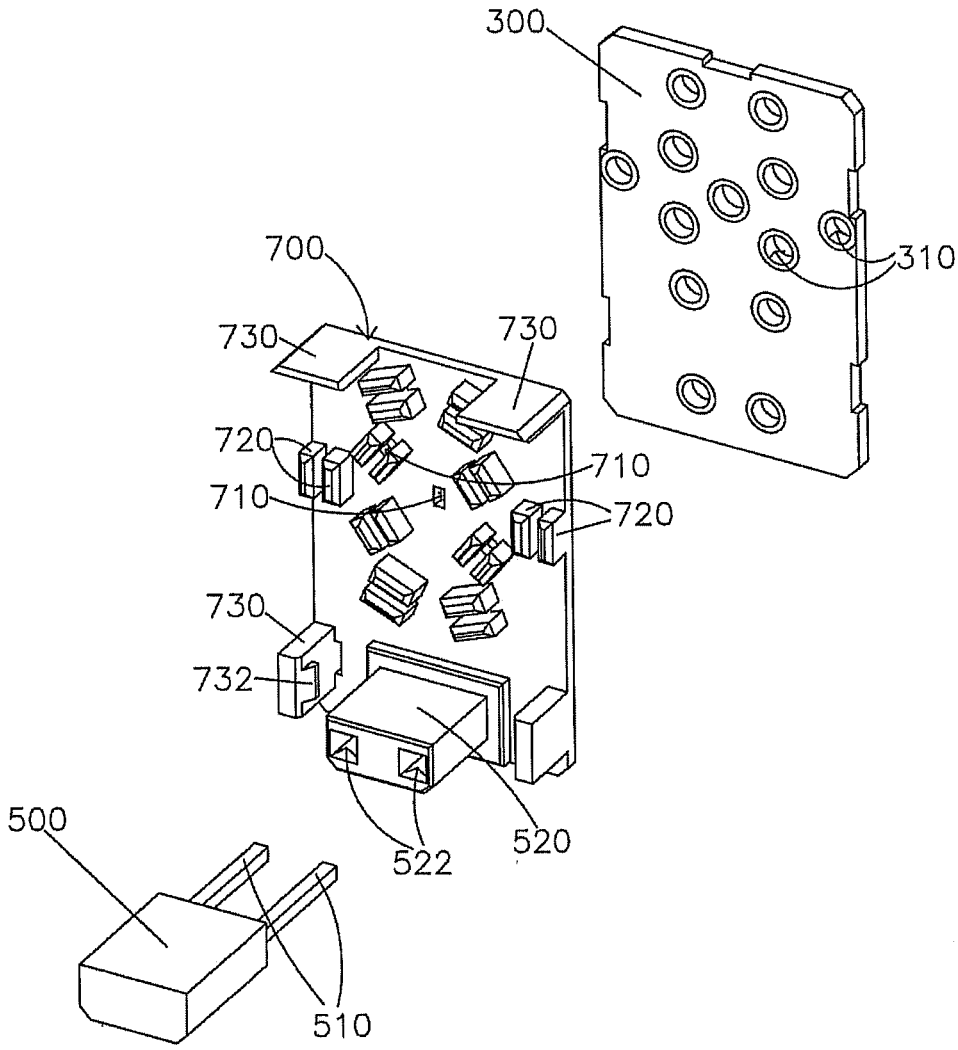
FIG. 5 is an exploded view of the present invention, showing the circuit connection unit, the plate, and the light emitting diode.

Here please refer to FIG. 5, wherein electrical connector structure further includes a plate 700 disposed between the circuit connection unit 300 and the isolation body 110. In the present embodiment, the light emitting diode 500 preferably further includes a guiding stand 520. The guiding stand 520 has a pair of jacks disposed corresponding to the conducting electrodes 510 of the light emitting diode 500 and guided to the corresponding first through holes 310 of the circuit connection unit 300. Furthermore, the guiding stand 520 is preferably integrated into one side of the plate 700. However, in the embodiment illustrated in FIG. 6, the guiding stand 520 can be separably disposed on the circuit connection unit 300 or the plate 700 based on design needs.

The plate 700 has a plurality of second through holes 710 corresponding to the above-mentioned first through holes 310. The aperture of each second through hole 710 is smaller than the aperture of each first through hole 310. In the embodiment illustrated in FIG. 5, two ribs 720 are used to guide the conduction portion (not illustrated) to correctly enter or pass through the second through hole 710. Furthermore, the plate 700 further includes a coupling plate 730 disposed perpendicular to the surface of the plate 700. A buckling portion 732 is disposed on the inner side of the coupling plate 730 to be coupled with the isolation body (not illustrated). The plate 700 is provided for preventing the occurrence of short-circuit caused by solder or tin paste permeating into the isolation body 110 when the conduction portions 214, 224, 234 and the circuit connection unit 300 are soldered together. However, the soldering process described here is commonly a soldering process using a reflow soldering system.

Figure 6:
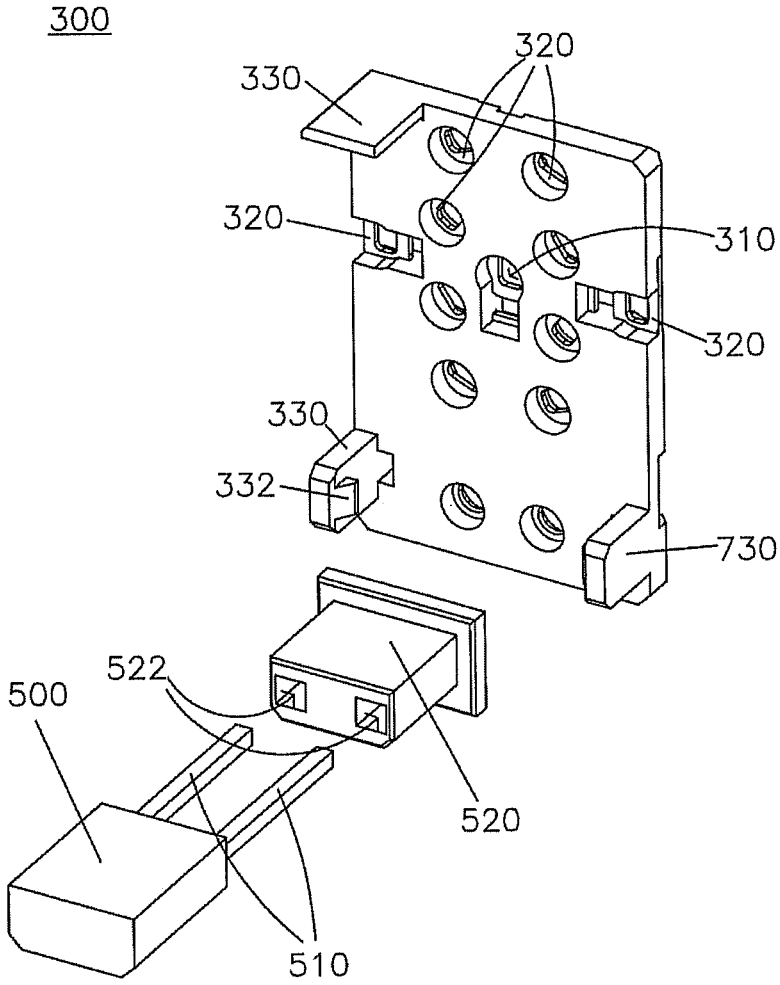
FIG. 6 is another exploded view of the present invention, showing the circuit connection unit and the light emitting diode.

As FIG. 6 shows, the circuit connection unit 300 can also be produced by an insert molding method. In other words, a plurality of pre-defined conductive films 326 are respectively produced by stamping, forging, or other suitable methods and then connected together using carriers 800 as illustrated in FIG. 7A. In the present embodiment, the assembly of the conductive films 326 forms a circuit layout 320. As for the stamping process, one piece of metal or alloy will be stamped into several conductive films 326 while punches 324, solder pads S1, S2, S3, S4, S5, and other structures can be formed simultaneously or separately on the conductive films 326. Here please also refer to FIG. 7B, wherein the solder pads 51, S2, S3, S4, S5 can be bent before or after stamping while the punch 324 is located where the first through hole 310 is located.

Figure 7B:
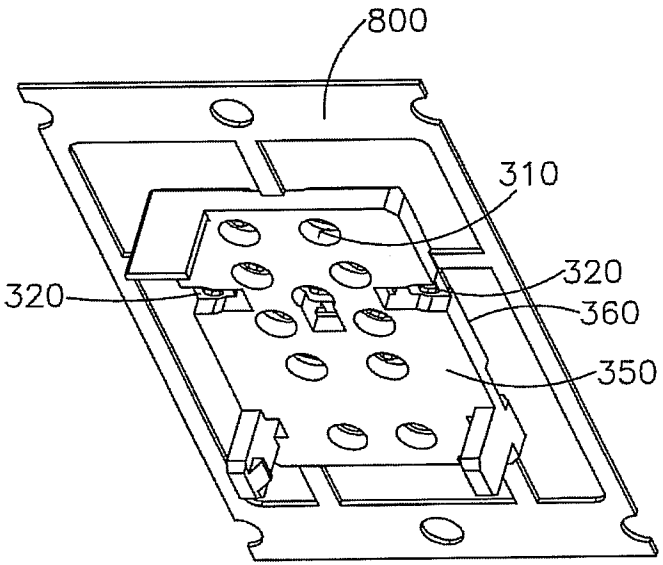
FIG. 7B is a schematic view of the circuit layout illustrated in FIG. 7A disposed with an injection-molded circuit connection unit.
Figure 7A:
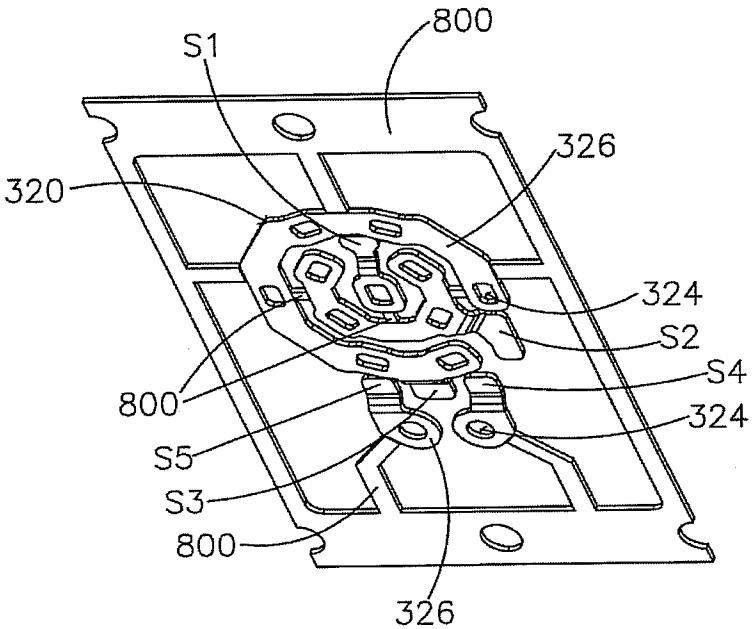
FIG. 7A is a schematic view of a pre-formed circuit layout of the present invention.
Figure 8B:
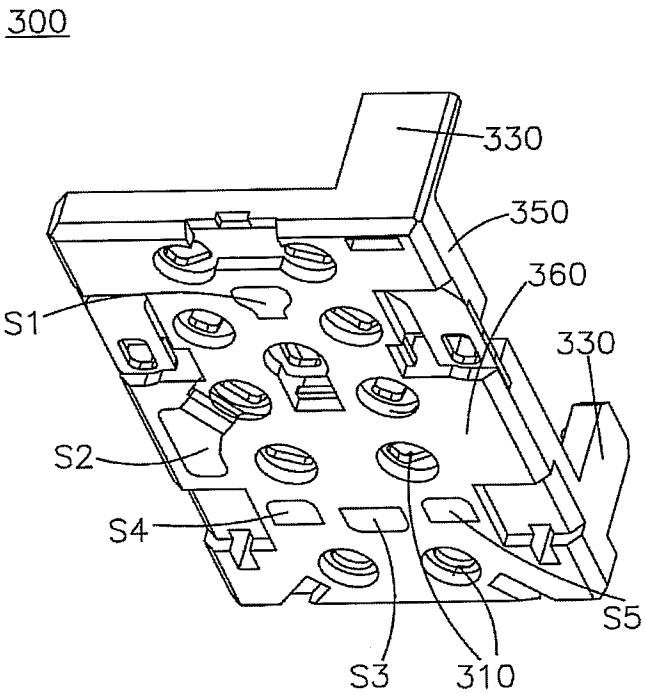
FIG. 8B is another schematic view of the circuit connection unit illustrated in FIG. 8A.
Figure 8A:
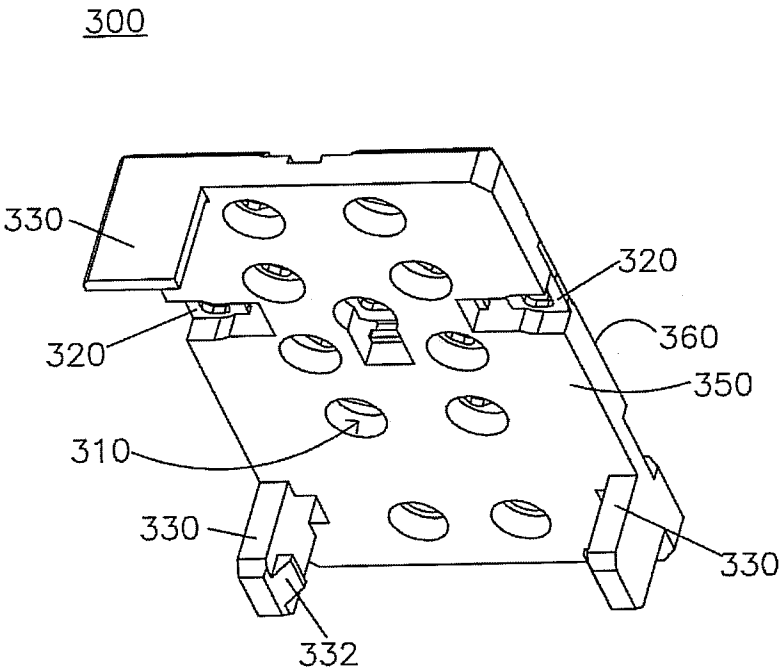
FIG. 8A is a schematic view of the circuit connection unit of FIG. 7A after removing excess carrier.

In the embodiments illustrated in FIG. 7A and FIG. 7B, the conductive films 326 are not directly connected and are only positioned using the carriers 800. As FIG. 7B shows, after the circuit layout 320 with carriers 800 is disposed in a mold (not illustrated whereas a portion of the carriers 800 will be exposed outside the mold) and liquid plastics are injected into the mold, a circuit connection unit 300 covered with a first plastic material 350 and a second plastic material 360 is formed after the liquid plastics solidify. The circuit connection unit 300 formed is produced using the insert molding method which is different from the printed circuit board processes of the embodiments mentioned above. As illustrated in FIG. 8A and FIG. 8B, the excess carriers 800 is then removed to create a circuit connection unit 300 which is an integration of plastics and metals.

In the embodiment illustrated in FIG. 8A and FIG. 8B, several coupling plates 330 are preferably formed perpendicularly on ends of the surface of the first plastic material 350. A buckling protrusion 332 is formed on the inner surface of the coupling plates 330 to be coupled with a coupling portion of the rear wall (not illustrated). However, in different embodiments, the coupling plate 330 and the buckling protrusion 332 can be omitted while the first plastic material 350 can be directly positioned on the rear wall of the isolation body by the corresponding structure of the metal casing as illustrated in FIG. 3.

It needs to be explained here that in the embodiment illustrated in FIG. 8B, the surface of each solder pad S1, S2, S3, S4, S5 is preferably aligned with the surface of the second plastic material 360. However, in different embodiments, the surfaces of the solder pads S1, S2, S3, S4, S5 need not be aligned with the surface of the second plastic material 360 and the solder pads S1, S2, S3, S4, S5 can be disposed at different height levels.

Figure 9:
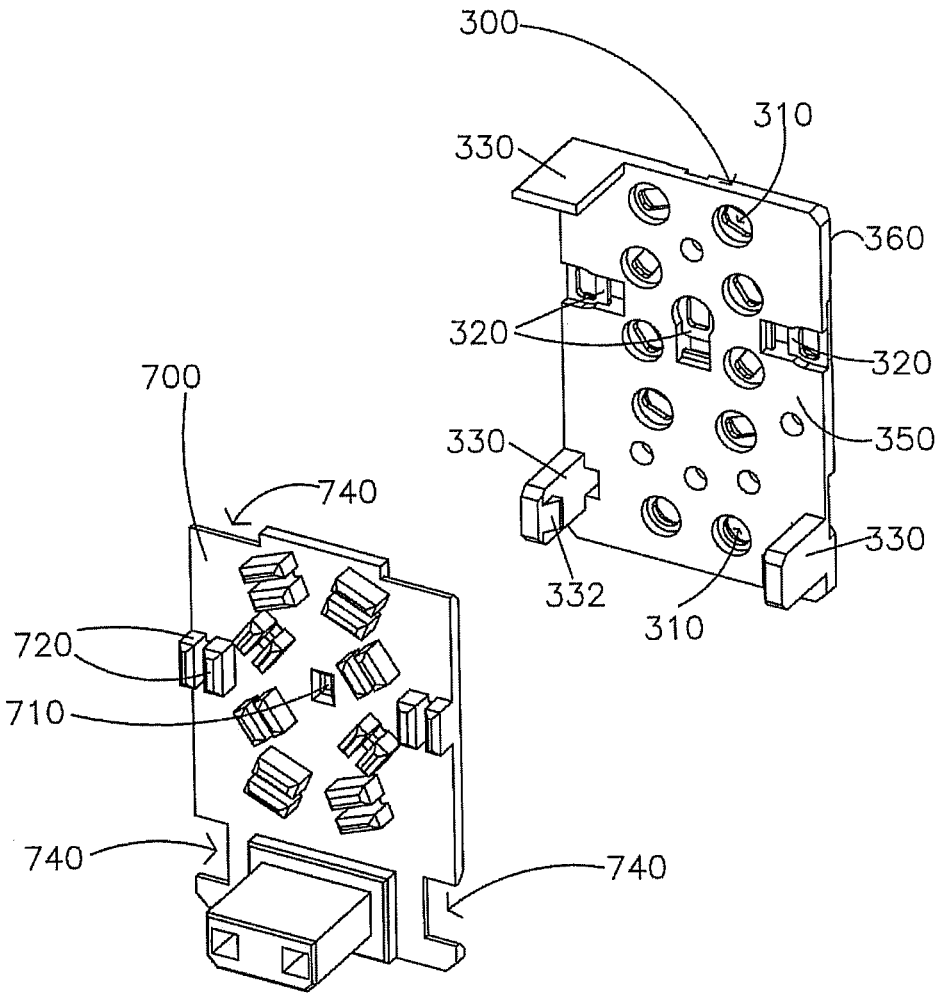
FIG. 9 is an exploded view of the circuit connection unit and the plate.

As FIG. 9 shows, an additional plate 700 can be added based on the soldering process employed, i.e. the process of electrically connecting the conduction portion with the circuit connection unit 300. In the embodiment illustrated in FIG. 9, the plate 700 is a rigid plastic substrate. However, in different embodiments, the plate 700 can be a soft and thin substrate made of silica gel, rubber, or other suitable materials.

In order to perform the reflow soldering process and prevent the solder or tin paste from flowing into the through holes 310, 710 and affecting the electrical connection, the plate 700 having a second through hole 710 smaller than the first through hole 310 is installed. The structure of the plate 700 can be referred back to the description of the embodiment illustrated in FIG. 5 and therefore is not elaborated here. However, it needs to be explained here that the coupling plates 330 are formed perpendicularly on ends of the surface of the circuit connection unit 300. In this way, notches are formed on the plate 700 at locations corresponding to the coupling plates 330.

Figure 10:
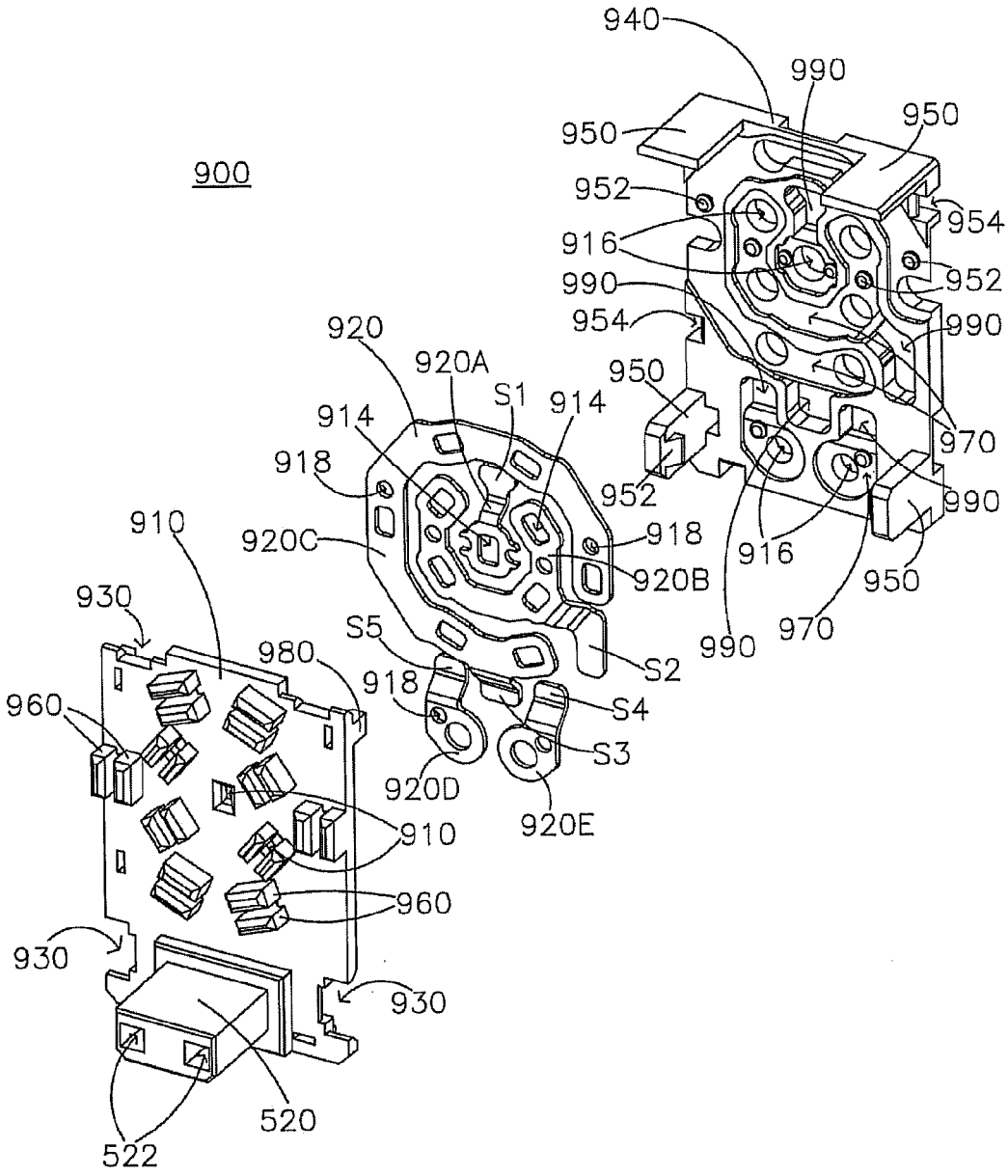
FIG. 10 is an exploded view illustrating another embodiment of the circuit connection unit.
Figure 11:
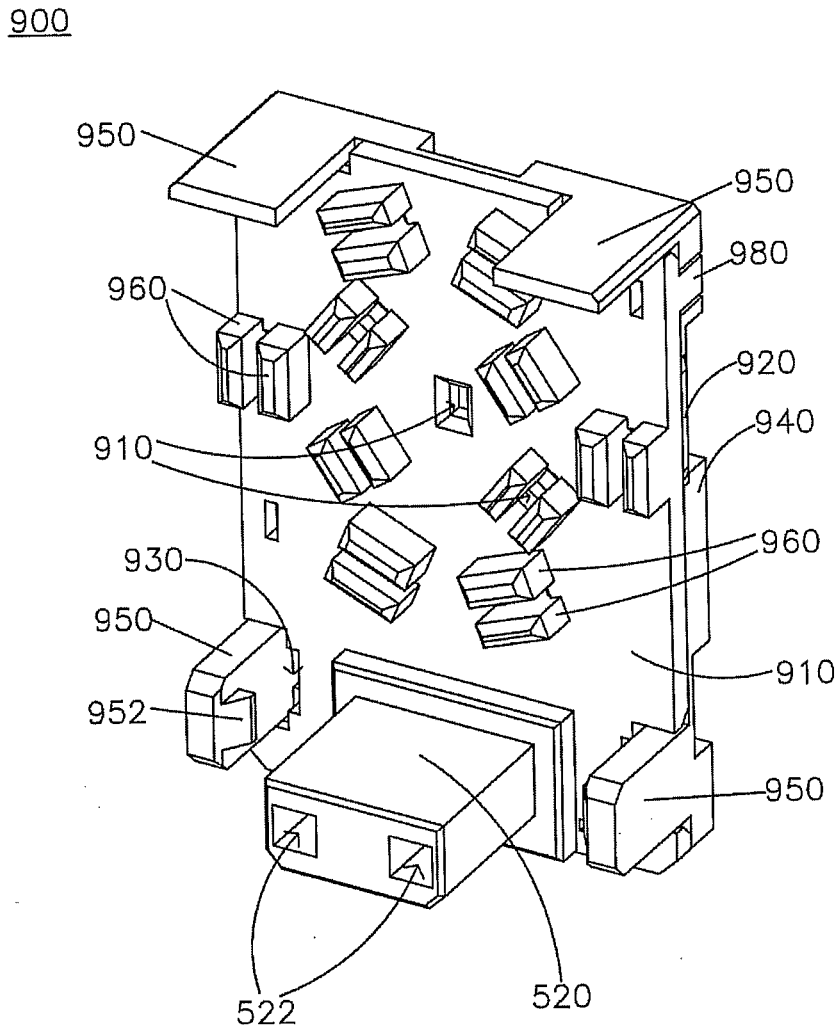
FIG. 11 is an assembled perspective view of the circuit connection unit illustrated in FIG. 10.

As shown in FIG. 10 and FIG. 11, the present invention further provides a circuit connection unit 900 produced by assembling elements together. The circuit connection unit 900 is composed of a first plastic body, 910, a second plastic body 940, and a plurality of conducting films 920. Slots 970 are formed on the inner surface of the second plastic body 940 and the shapes of the slots 970 respectively correspond to the shape of the conducting films 920A, 920B, 920C, 920D, 920E to position the conducting films 920. Solder pads S1, S2, S3, S4, and S5 are connected to one end of the corresponding conducting films 920A, 920B, 920C, 920D, 920E. Solder pad holes 990 are formed on the second plastic body 940 at locations corresponding to the solder pads S1, S2, S3, S4, and S5 for a wire to be soldered thereon.

Figure 12:
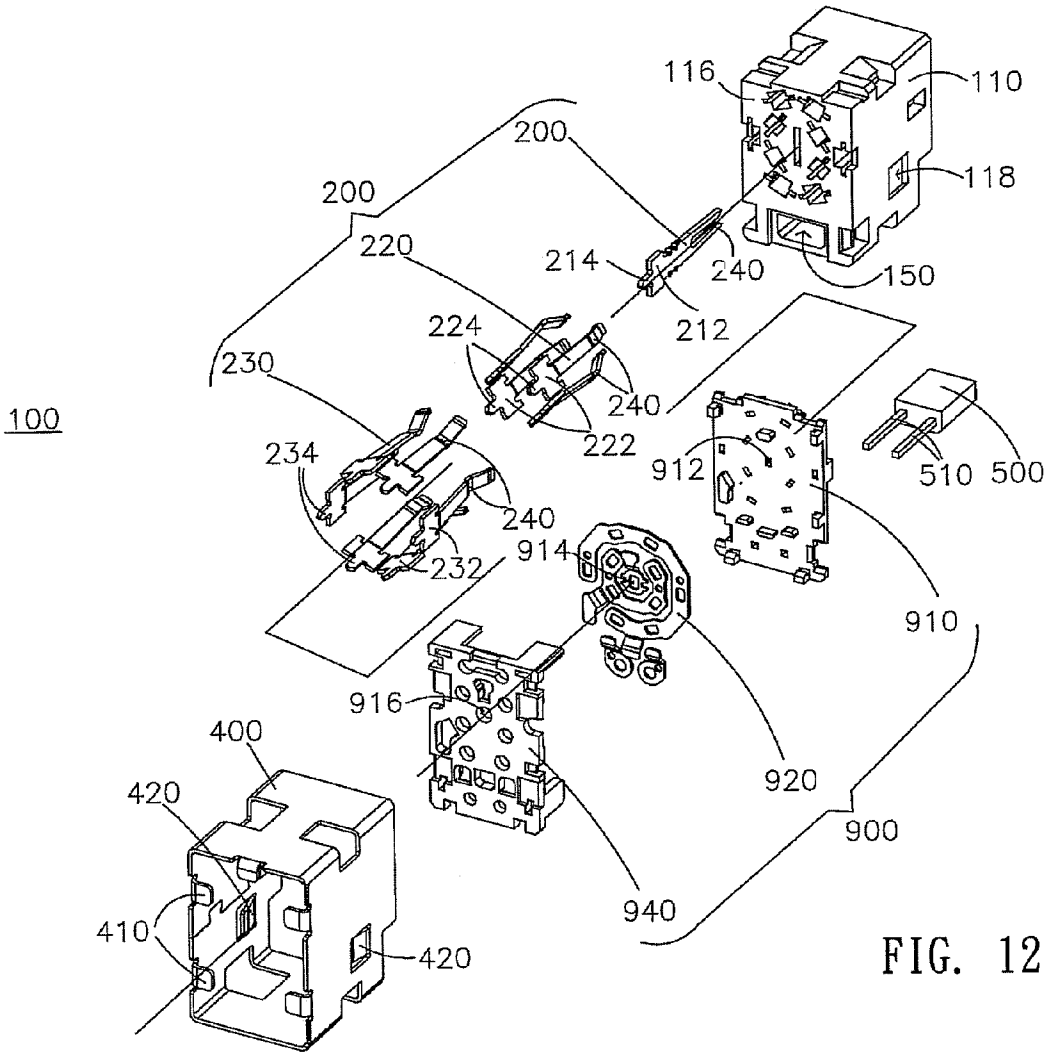
FIG. 12 is an exploded view of an embodiment of the electrical connector structure including the circuit connection unit that is composed of the first plastic body, the second plastic body, and a plurality of conducting films.

The second plastic body 940 further includes several coupling plates 950, several positioning portions 952, and several notches 954. The conducting film 920 has several positioning holes 918 to be coupled with the positioning portions 952 for positioning purposes. The first plastic body 910 has several notches 930, several coupling portions 980, and a plurality of ribs 960. Also as FIG. 11 and FIG. 12 show, the notch 930 allows the coupling plate 950 to pass through and the buckling protrusion 932 is engaged with the buckling portion 160 of the isolation body 110. Furthermore, the coupling portion 980 of the first plastic body 910 couples with the notch 954 on the second plastic body 940 to further reinforce the connection between the first plastic body 910 and the second plastic body 940.

As FIGS. 10 to 12 show, each of the conducting films 920A, 920B, 920C, 920D, and 920E uses different positioning mechanisms mentioned above to be installed between the first plastic body 910 and the second plastic body 940. However, in different embodiments, elements such as the positioning holes 918, the coupling plates 950, the positioning portions 952, the notches 954, or the coupling portions 980 can be disposed at different locations, have different structures, or be interchangeably modified based on design needs and thus are not limited to the embodiments. Furthermore, the first through hole 914 of each conducing film 920 corresponds to the second through holes 912, 916 on the first plastic body 910 and the second plastic body 940. The ribs 960 of the first plastic body 910 are disposed in pair opposite to each other to guide the conduction portions 214, 224, 234 to be plugged in the through holes 912, 914, 916 of the circuit connection unit 300.

In the embodiments illustrated in FIGS. 10 to 12, the circuit connection unit 900 further provides a light emitting diode 500 having a pair of conducting electrodes 510. The light emitting diode 500 further includes a guiding stand 520 having a pair of jacks 522 to be positioned on the first plastic body 910. However, in different embodiments, the electrical connector structure 100 can omit the light emitting diode 500. In the present embodiment, the light emitting diode 500 is substantially disposed on the guiding stand 520 of the circuit connection unit 300 and then installed in the slot 150, wherein the guiding stand 520 and the first plastic body 910 are preferably formed as a unibody. However, in different embodiments, the guiding stand 520 can be separably disposed on the first plastic body 910 or the circuit connection unit 900.

The soldering process is performed when the conduction portions 214, 224, 234 of the pole set 200 and the conducting electrodes 510 of the light emitting diode 500 pass through the through holes 912, 914, 916 and the jacks 522, respectively, wherein the soldering process includes but is not limited to the tin soldering process or the reflow soldering process. In other words, the conduction portions 214, 224, 234 are electrically coupled with the conducting films 920A, 920B, 920C, 920D, 920E using soldering processes mentioned above. The wiring process can be conducted after steps mentioned above are completed, i.e. the wire (not illustrated) can be coupled with the solder pads S1, S2, S3, S4, S5 formed on the circuit connection unit 900.

Figure 13:
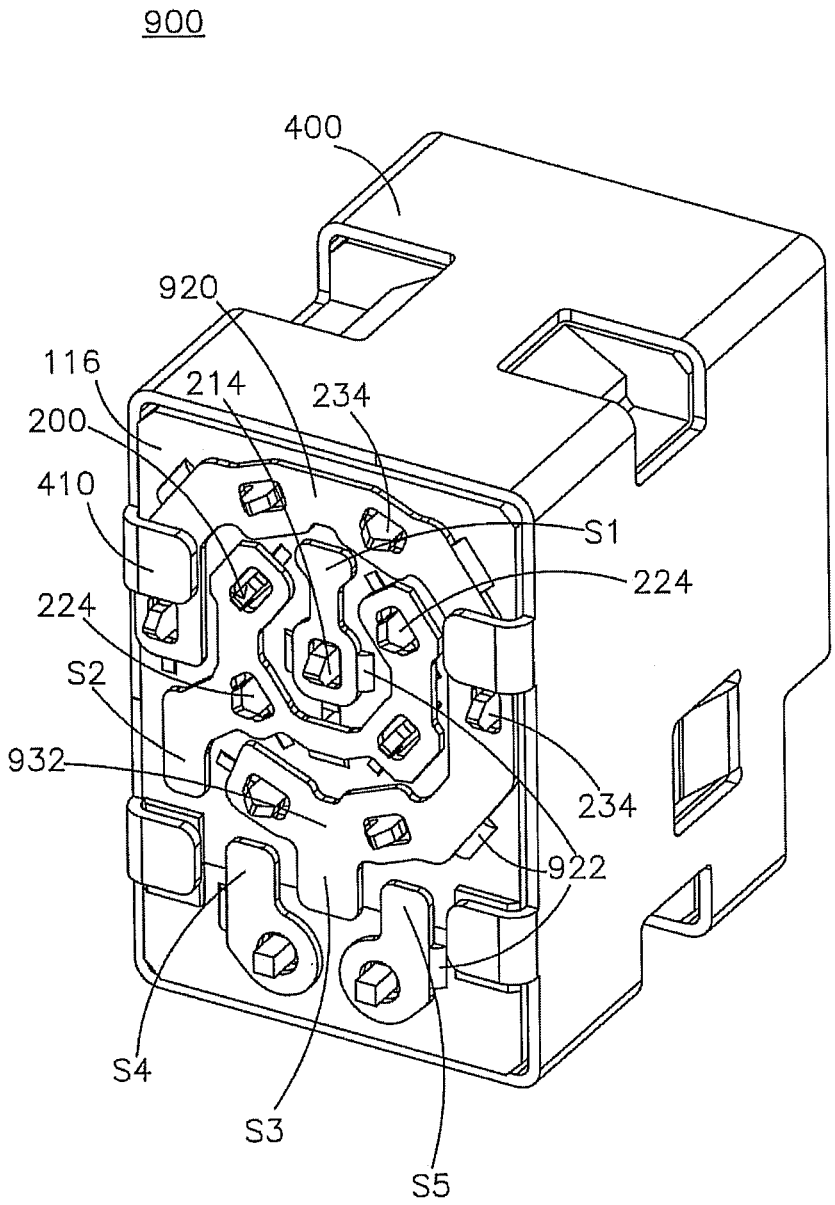
FIG. 13 is a schematic view of the electrical connector structure of the present invention, showing a plurality of conducting films (circuit layout) disposed on the rear wall of the isolation body.
Figure 14:
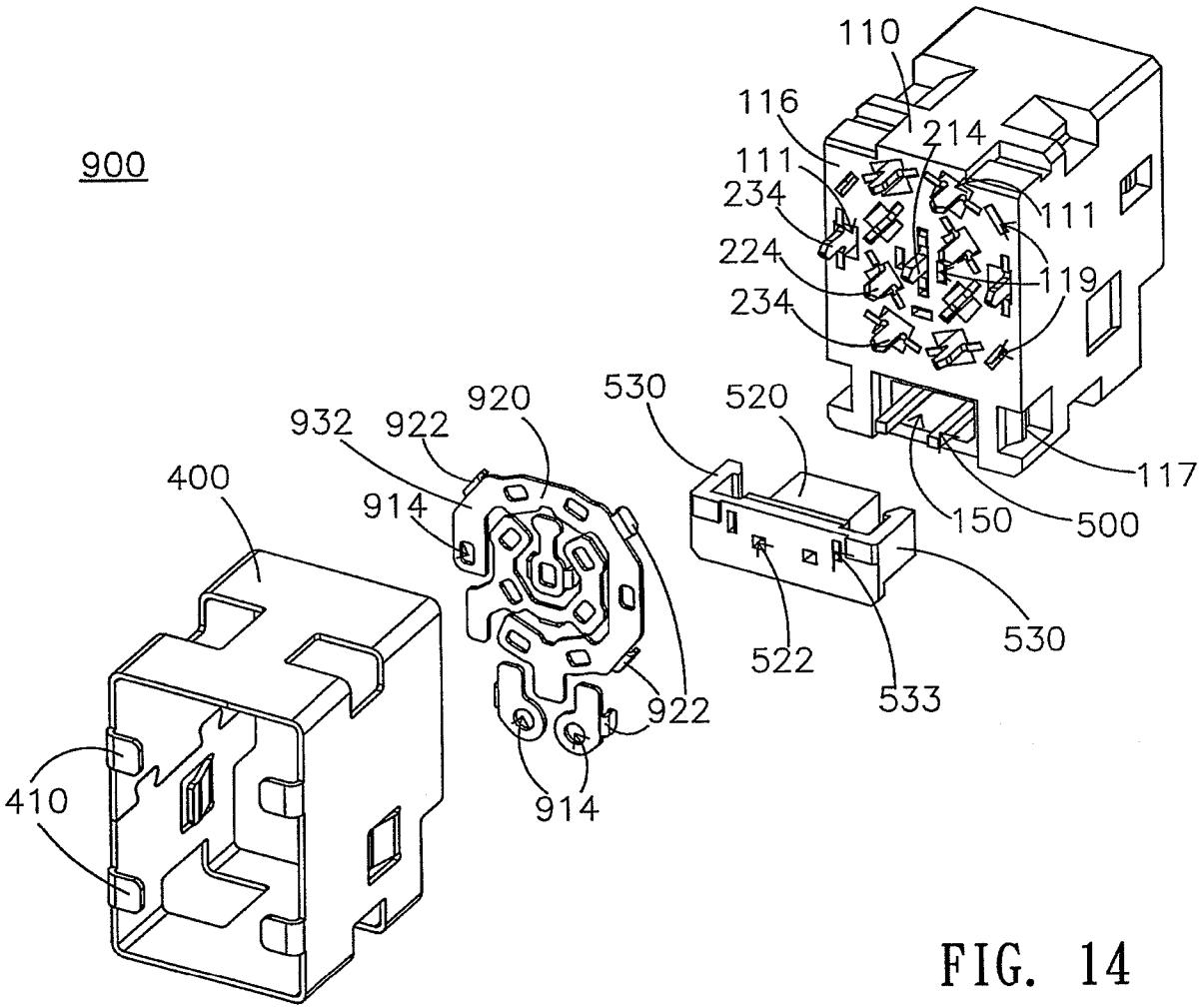
FIG. 14 is a partial exploded view of the electrical connector structure illustrated in FIG. 13.

As FIG. 13 shows, the present invention further provides an electrical connector structure 100 with conducting films 920 directly disposed on the rear wall 116 of the isolation body 110. As FIG. 14 shows, in the present embodiment, the pole set 200 is substantially disposed in the isolation body 110, wherein the conduction portions 214, 224, 234 pass through the terminal grooves 111 of the isolation body 110 and the light emitting diode 500 is disposed in the slot 150. The guiding stand 520 having the jacks 522 are coupled with the corresponding conducting electrodes 510, wherein two sides of the guiding stand 520 are disposed with two arms 530 to be coupled with the buckling portion 117 at two sides of the slot 150 to position the guiding stand 520 on the isolation body 110. Two conducting electrodes 510 pass through the jacks 522 of the guiding stand 520 and appear from the surface of the guiding stand 520. The circuit layout 932 formed by a plurality of conducting films 920 can be directly disposed on the rear wall 116. As FIG. 13 and FIG. 14 show, the circuit layout 932 is preferably coupled with the positioning holes 119 of the rear wall 116 by the buckling portions 922 perpendicular to the surface of each conducting film 920, wherein the bent portion 410 of the metal casing 400 further fixes the circuit layout 932 on the isolation body 110.

In the embodiment illustrated in FIG. 13, the bent portion 410 is attached to the conducting film 920 with the same polarity and therefore will not cause short-circuit and the bent portion 410 can even be used as the system ground. The conducting portions 214, 224, 234 are soldered with the corresponding conducting films 920 to establish the circuit connection as the conducting portions 214, 224, 234 pass through the corresponding first through holes 914 and are then positioned on the rear wall 116. Afterward wires or cables (not illustrated) can be soldered selectively with the protruding conducting portions 214, 224, 234 or the solder pads S1, S2, S3, S4, and S5. However, in different embodiments, a low-pressure packaging film (not illustrated) can be applied on the conducting portions 214, 224, 234 and the solder pads S1, S2, S3, S4, S5 to improve the stability and reliability of the soldering process of the wires or cables.

It needs to be emphasized here that as FIGS. 13 and 14 show, the conducting portions 214, 224, 234 and the circuit layout 932 are preferably soldered together by the tin soldering process. However, in the embodiment illustrated in FIG. 15, the reflow soldering process can also be used to solder the conducting portions 214, 224, 234 and the circuit layout 932 together. As for the reflow soldering process, a first plastic body 910 whose structure is similar to the plate mentioned above is disposed between the isolation body 110 and the circuit layout 932 in order to prevent tin solder, tin paste, or other solder from permeating into the terminal grooves 111. Here please refer to FIG. 10 and related descriptions for the structure and the material of the first plastic body 910 that are not be elaborated here.

Figure 15:
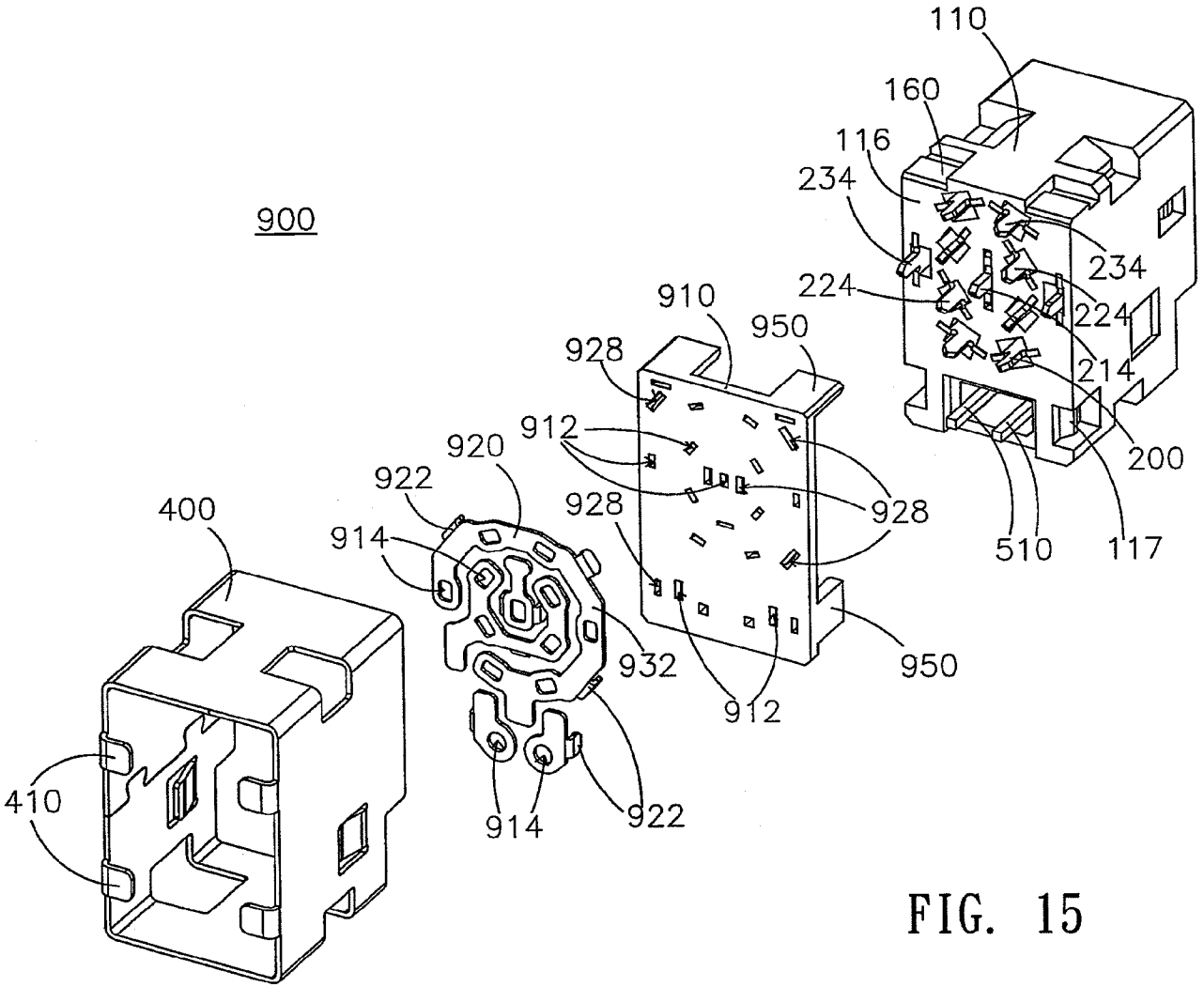
FIG. 15 is another partial exploded view of the electrical connector structure illustrated in FIG. 13.

As FIG. 15 shows, the circuit layout 932 is disposed in the first plastic body 910 and then assembled on the rear wall 116. In the present embodiment, the conducting film 920 is preferably attached to the positioning hole 928 of the first plastic body 910 using one or more buckling portions 922. The coupling plates 950 located at four corners of the first plastic body 910 then couple with the coupling portions 117, 160 of the isolation body 110. Finally, the bent portions 410 of the metal casing 400 are used to position the conducting film 920 on the first plastic body 910 and the assembled circuit connection unit 900 is illustrated in FIG. 13.

Furthermore, the first plastic body 910 further includes a plurality of second through holes 912 corresponding to the conduction portions 214, 224, 234 of the pole set 200. The circuit layout 932 includes a plurality of first through holes 914 corresponding to the locations of the second through holes 912. In this way, when the circuit layout 932 and the first plastic body 910 are assembled with the isolation body 110, the conduction portions 214, 224, 234 will pass through the second through holes 912 of the first plastic body 910 and the first through holes. As FIG. 13 shows, the conduction portions 214, 224, 234 are then exposed outside the surface of the circuit layout 932 for being soldered with wires or cables.

Figure 16:
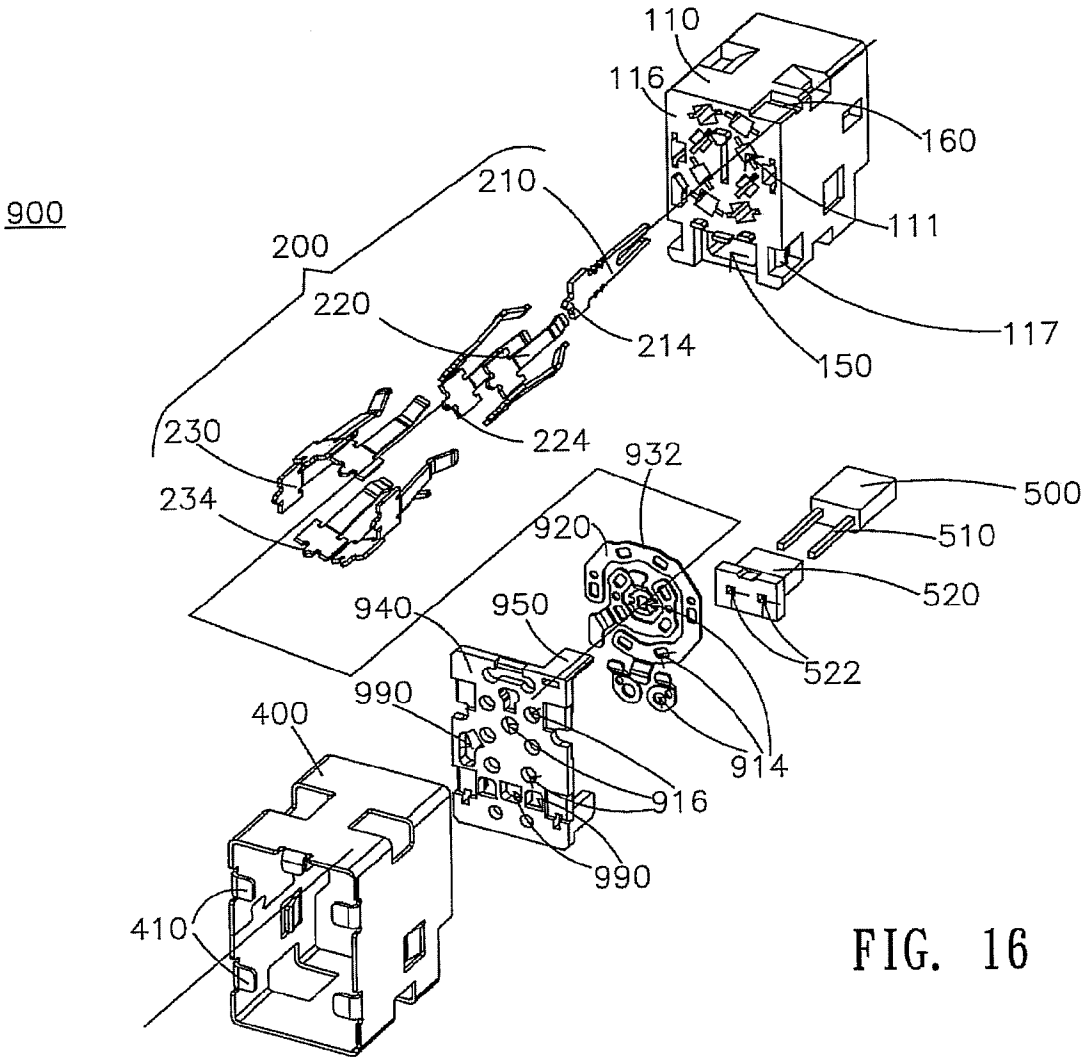
FIG. 16 is an exploded view of another embodiment of the electrical connector structure, showing the conducting films disposed on the rear wall of the isolation body.
Figure 17:
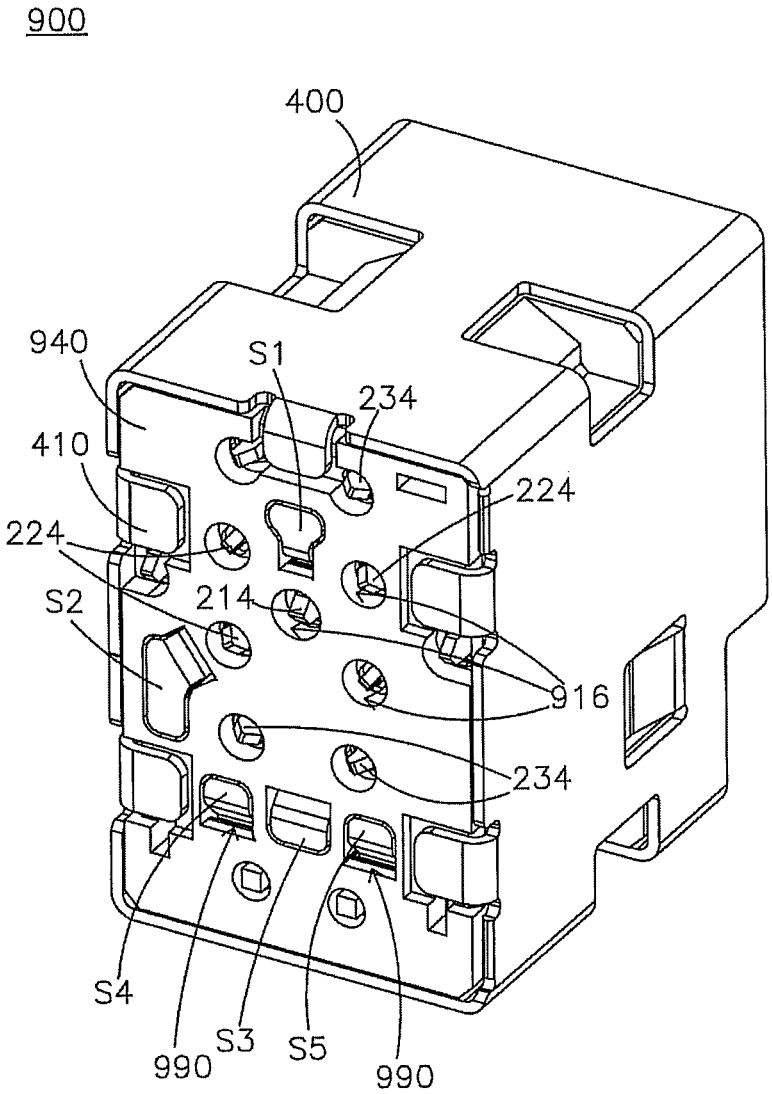
FIG. 17 is an assembled perspective view of the electrical connector structure illustrated in FIG. 16.

As FIG. 16 and FIG. 17 show, the present invention further includes an electrical connector structure 900 with multi-poles, wherein the circuit layout 932 is covered by the second plastic body 940 and also fixed on the isolation body 110. In the embodiment illustrated in FIG. 16, the second plastic body 940 has a plurality of second through holes 916 and a plurality of coupling plate 950. Each second through hole 916 corresponds to one of the first through holes 914 and is disposed corresponding to one of the conduction portions 214, 224, 234 of the pole set 200 so that those conduction portions 214, 224, 234 can pass through the corresponding first through holes 914 and the corresponding second through holes 916. In the embodiment illustrated in FIG. 17, the conduction portions 214, 224, 234 preferably do not protrude over the outer surface of the second plastic body 940. However, in different embodiments, a portion of the conduction portions 214, 224, 234 can protrude over the outer surface of the second plastic body 940 in order to electrically couple with wires. As FIG. 16 shows, the above-mentioned coupling plates 950 preferably protrude perpendicularly from the end surface of the second plastic body 940 to couple with the coupling portions 117, 160 of the rear wall 160.

Furthermore, the present embodiment is preferably used in the reflow soldering process. However, in different embodiments, the conduction portions 214, 224, 234 can be manually soldered with corresponding first through holes 914 of the conducting film 920. In the embodiment illustrated in FIG. 16 and FIG. 17, the solder pads S1, S2, S3, S4, and S5 of the circuit layout 932 are preferably parallel with the surface of each conducting film 920 and are preferably exposed outside the solder pad holes 990 of the second plastic body 940. The light emitting diode 500 is installed in the slot 150 of the isolation body 110 using the guiding stand 520. After the circuit layout 932 and the second plastic body 940 are disposed on the rear wall 116, some bent portions 410 of the metal casing 400 can be used to position the second plastic body 940 together with the isolation body 110.

The above is detailed descriptions of the particular embodiments of the invention which is not intended to limit the invention to the embodiments described. It is recognized that modifications within the scope of the invention will occur to a person skilled in the art. Such modifications and equivalents of the invention are intended for inclusion within the scope of this invention.

What is claimed is:

1. An electrical connector structure with multi-poles, comprising:

an isolation body having a core portion and a recessed ring portion formed around a periphery of the core portion; wherein the core portion extends from a rear wall of the isolation body toward a front surface of the isolation body;

a pole set including a centre pole, a first pole, and a second pole, the centre pole being disposed in the core portion, the first pole being disposed on an inner side of the recessed ring portion, the second pole being disposed on an outer side of the recessed ring portion, wherein the centre pole, the first pole, and the second pole each includes a main portion and a conduction portion extending from the main portion to a rear wall of the isolation body, the main portion is embedded in the rear wall of the isolation body; and a circuit connection unit disposed on the rear wall of the isolation body, the circuit connection unit including a preformed circuit layout parallel to the front surface of the isolation body and a plurality of first through holes, wherein the first through holes are formed on the circuit layout.

2. The electrical connector structure of claim 1, wherein the core portion includes a first groove on a surface of the core portion, the first pole is disposed in the first groove, the isolation body includes a second groove on a surface of the isolation body near the recessed ring portion, and the second pole is disposed in the second groove.

3. The electrical connector structure of claim 1, wherein the first pole and the second pole each includes an elastic portion, the elastic portion extends from the main portion and is exposed in the recessed ring portion.

4. The electrical connector structure of claim 1, wherein the first pole and the second pole respectively include a plurality of first poles and a plurality of second poles, the main portions of each first pole and each second pole are individually or integrally embedded in the rear wall of the isolation body.

5. The electrical connector structure of claim 1, further comprising a plate disposed between the circuit connection unit and the isolation body.

6. The electrical connector structure of claim 5, wherein the plate includes a plurality of second through holes corresponding to the first through holes, an aperture of each second through hole is smaller than an aperture of each first through hole.

7. The electrical connector structure of claim 1, wherein the circuit connection unit is further covered with a first plastic material and a second plastic material.

8. The electrical connector structure of claim 7, wherein the first plastic material and the second plastic material are liquid solution before covering the circuit layout.

9. The electrical connector structure of claim 1, wherein the circuit connection unit is composed of a first plastic body, a second plastic body, and a plurality of conducting films.

10. An electrical connector structure with multi-poles, comprising:

a light emitting diode having a set of conducting electrodes;

an isolation body having a core portion extending from a rear wall of the isolation body toward a front surface of the isolation body, a recessed ring portion formed around a periphery of the core portion, and a slot located near the recessed ring portion, wherein the light emitting diode is disposed in the slot;

a pole set including a centre pole, a plurality of first poles, and a plurality of second poles, wherein the centre pole is disposed in the core portion, the first poles are respectively disposed on an inner side of the recessed ring portion, the second poles are respectively arranged on an outer side of the recessed ring portion, wherein the centre pole, the first poles, and the second poles each includes a main portion and a conduction portion extending from the main portion to a rear wall of the isolation body, the main portion is embedded the rear wall of the isolation body; and a circuit connection unit disposed on the rear wall of the isolation body, the circuit connection unit including a preformed circuit layout parallel to the front surface of the isolation body and a plurality of first through holes, wherein the first through holes are disposed corresponding to the conduction portions for electrically connecting the circuit layout with the conduction portions and the set of conducting electrodes.

11. The electrical connector structure of claim 10, further comprising a guiding stand having a pair of jacks, wherein the guiding stand is disposed on the circuit connection unit or in the slot so that the set of conducting electrodes can pass through the pair of jacks and into the first through holes.

12. The electrical connector structure of claim 10, wherein the core portion includes a plurality of first grooves on a surface of the core portion, the first poles are respectively disposed in the first grooves, the isolation body includes a plurality of second grooves on a surface of the isolation body near the recessed ring portion, the second poles are respectively disposed in the second grooves.

13. An electrical connector structure, comprising:

an isolation body having a core portion and a recessed ring portion formed around a periphery of the core portion;

a pole set including a centre pole, a first pole, and a second pole, the centre pole being disposed in the core portion, the first pole being disposed on an inner side of the recessed ring portion and the second pole being disposed on an outer side of the recessed ring portion, wherein the centre pole, the first pole, and the second pole each includes a main portion and a conduction portion extending from the main portion to a rear wall of the isolation body, the main portion is embedded in the rear wall of the isolation body; and a plurality of conductive films, each conductive film being pre-defined to form a circuit layout and disposed on the rear wall of the isolation body, a plurality of first through holes being respectively formed on the conductive films, at least one of the conductive films having a solder pad, wherein the first through holes are disposed corresponding to the conduction portions for electrically connecting the conducting portions or the solder pad with the circuit layout.

14. The electrical connector structure of claim 13, wherein the solder pad is bent away from the rear wall so that a surface of the solder pad is not level with a surface of the conductive films.

15. The electrical connector structure of claim 13, further comprising a first plastic body disposed between the conductive films and the isolation body, the first plastic body having a plurality of second through holes corresponding to the first through holes, wherein an aperture of each second through hole is smaller than an aperture of each first through hole.

16. The electrical connector structure of claim 13, further comprising a second plastic body disposed on one side of the conductive films opposite to the isolation body for positioning the conductive films on the rear wall, wherein the second plastic body has a plurality of second through holes corresponding to the firs through holes for allowing the conduction portions to pass through.

* * * * *